US008718288B2

(12) United States Patent
Woods et al.

(10) Patent No.: US 8,718,288 B2
(45) Date of Patent: May 6, 2014

(54) SYSTEM FOR CUSTOMIZING HEARING ASSISTANCE DEVICES

(75) Inventors: William S. Woods, Berkeley, CA (US); Brent Edwards, San Francisco, CA (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 1471 days.

(21) Appl. No.: 11/957,161

(22) Filed: Dec. 14, 2007

(65) Prior Publication Data

US 2009/0154741 A1 Jun. 18, 2009

(51) Int. Cl.
*H04R 25/00* (2006.01)

(52) U.S. Cl.
USPC ..... 381/60; 381/312; 381/314

(58) Field of Classification Search
USPC ..... 381/60; 380/60, 312, 314
See application file for complete search history.

(56) References Cited

U.S. PATENT DOCUMENTS

| | | | |
|---|---|---|---|
| 3,527,901 | A | 9/1970 | Geib |
| 4,366,349 | A | 12/1982 | Adelman |
| 4,396,806 | A | 8/1983 | Anderson |
| 4,419,544 | A | 12/1983 | Adelman |
| 4,471,171 | A | 9/1984 | Kopke et al. |
| 4,471,490 | A | 9/1984 | Bellafiore |
| 4,637,402 | A | 1/1987 | Adelman |
| 4,697,242 | A | 9/1987 | Holland et al. |
| 4,882,762 | A | 11/1989 | Waldhauer |
| 5,226,086 | A | 7/1993 | Platt |
| 5,390,254 | A | 2/1995 | Adelman |
| 5,434,924 | A | 7/1995 | Jampolsky |
| 5,502,769 | A | 3/1996 | Gilbertson |
| 5,553,152 | A | 9/1996 | Newton |
| 5,581,747 | A | 12/1996 | Anderson |
| 5,604,812 | A | 2/1997 | Meyer |
| 5,659,621 | A | 8/1997 | Newton |
| 5,687,279 | A | 11/1997 | Matthews |

(Continued)

FOREIGN PATENT DOCUMENTS

| | | |
|---|---|---|
| DE | 10053179 A1 | 5/2001 |
| DE | 10062649 | 6/2001 |

(Continued)

OTHER PUBLICATIONS

"U.S. Appl. No. 10/051,757, Notice of Allowance mailed Oct. 5, 2009", 13 pgs.

(Continued)

*Primary Examiner* — Yu Chen
(74) *Attorney, Agent, or Firm* — Schwegman, Lundberg & Woessner, P.A.

(57) ABSTRACT

Disclosed herein, among other things, is a system for customizing a hearing assistance device for a wearer. According to various embodiments, data corresponding to the wearer's acoustic environment is logged using the hearing assistance device. In various embodiments, the hearing assistance device is fitted by an adaptive fitting process controlled by the wearer, the adaptive fitting process having access to the data logged by the hearing assistance device to customize settings of the hearing assistance device for the wearer. In an embodiment, data related to fitting the hearing assistance device is sent via a network connection to a location accessible by the wearer's audiologist and/or device manufacturer. The sent data is used to create an interactive database, and the database is used for fitting hearing assistance devices for one or more wearers, in various embodiments.

31 Claims, 3 Drawing Sheets

(56) References Cited

U.S. PATENT DOCUMENTS

| | | | | |
|---|---|---|---|---|
| 5,706,352 | A | 1/1998 | Engebretson et al. | |
| 5,724,433 | A | 3/1998 | Engebretson et al. | |
| 5,757,933 | A | 5/1998 | Preves et al. | |
| 5,793,644 | A | 8/1998 | Koford et al. | |
| 5,822,442 | A | 10/1998 | Agnew et al. | |
| 5,825,631 | A | 10/1998 | Prchal | |
| 5,835,611 | A | 11/1998 | Kaiser et al. | |
| 5,852,668 | A | 12/1998 | Ishige et al. | |
| 5,862,238 | A | 1/1999 | Agnew et al. | |
| 5,946,673 | A | 8/1999 | Francone et al. | |
| 6,035,050 | A | 3/2000 | Weinfurtner et al. | |
| 6,041,129 | A | 3/2000 | Adelman | |
| 6,118,877 | A | 9/2000 | Lindemann et al. | |
| 6,148,274 | A | 11/2000 | Watanabe et al. | |
| 6,236,731 | B1 | 5/2001 | Brennan et al. | |
| 6,240,192 | B1 | 5/2001 | Brennan et al. | |
| 6,347,148 | B1 | 2/2002 | Brennan et al. | |
| 6,366,863 | B1 | 4/2002 | Bye et al. | |
| 6,389,142 | B1 | 5/2002 | Hagen et al. | |
| 6,449,662 | B1 | 9/2002 | Armitage | |
| 6,718,301 | B1 | 4/2004 | Woods | |
| 6,879,860 | B2 | 4/2005 | Wakefield | |
| 6,885,752 | B1 | 4/2005 | Chabries et al. | |
| 6,888,948 | B2 | 5/2005 | Hagen et al. | |
| 6,925,555 | B2 | 8/2005 | Chang et al. | |
| 7,006,646 | B1 | 2/2006 | Baechler | |
| 7,149,320 | B2 | 12/2006 | Haykin et al. | |
| 7,242,777 | B2 | 7/2007 | Leenen et al. | |
| 7,283,638 | B2 | 10/2007 | Troelsen et al. | |
| 7,283,842 | B2 | 10/2007 | Berg | |
| 7,343,021 | B2 | 3/2008 | Takagi et al. | |
| 7,349,549 | B2 | 3/2008 | Bachler et al. | |
| 7,428,312 | B2 | 9/2008 | Meier et al. | |
| 7,650,004 | B2 | 1/2010 | Durant | |
| 7,869,606 | B2 * | 1/2011 | Fichtl et al. | 381/60 |
| 7,986,790 | B2 | 7/2011 | Zhang et al. | |
| 2001/0005420 | A1 | 6/2001 | Takagi et al. | |
| 2001/0007050 | A1 | 7/2001 | Adelman | |
| 2001/0033664 | A1 | 10/2001 | Poux et al. | |
| 2001/0055404 | A1 | 12/2001 | Bisgaard | |
| 2002/0012438 | A1 | 1/2002 | Leysieffer et al. | |
| 2002/0039426 | A1 | 4/2002 | Takemoto et al. | |
| 2002/0076073 | A1 | 6/2002 | Taenzer et al. | |
| 2003/0007647 | A1 | 1/2003 | Nielsen et al. | |
| 2003/0112988 | A1 | 6/2003 | Naylor | |
| 2003/0133578 | A1 | 7/2003 | Durant | |
| 2004/0066944 | A1 | 4/2004 | Leenen et al. | |
| 2004/0181266 | A1 | 9/2004 | Wakefield et al. | |
| 2004/0190739 | A1 | 9/2004 | Bachler et al. | |
| 2004/0202340 | A1 | 10/2004 | Armstrong et al. | |
| 2005/0107845 | A1 | 5/2005 | Wakefield | |
| 2005/0111683 | A1 | 5/2005 | Chabries et al. | |
| 2005/0129262 | A1 | 6/2005 | Dillon et al. | |
| 2005/0281421 | A1 * | 12/2005 | Armstrong | 381/311 |
| 2005/0283263 | A1 | 12/2005 | Eaton et al. | |
| 2006/0093997 | A1 * | 5/2006 | Kearby et al. | 434/185 |
| 2006/0153395 | A1 * | 7/2006 | van Den Heuvel et al. | 381/60 |
| 2006/0161391 | A1 | 7/2006 | Inaba et al. | |
| 2006/0178711 | A1 | 8/2006 | Patrick et al. | |
| 2006/0215860 | A1 | 9/2006 | Wyrsch | |
| 2006/0222194 | A1 | 10/2006 | Bramslow | |
| 2006/0227987 | A1 | 10/2006 | Hasler | |
| 2007/0009123 | A1 | 1/2007 | Aschoff et al. | |
| 2007/0019817 | A1 | 1/2007 | Siltmann | |
| 2007/0041589 | A1 * | 2/2007 | Patel et al. | 381/73.1 |
| 2007/0076909 | A1 | 4/2007 | Roeck et al. | |
| 2007/0116308 | A1 | 5/2007 | Zurek et al. | |
| 2007/0117510 | A1 | 5/2007 | Elixmann | |
| 2007/0135862 | A1 | 6/2007 | Nicolai et al. | |
| 2007/0217620 | A1 | 9/2007 | Zhang et al. | |
| 2007/0217629 | A1 | 9/2007 | Zhang et al. | |
| 2007/0217636 | A1 | 9/2007 | Schwob et al. | |
| 2007/0219784 | A1 | 9/2007 | Zhang et al. | |
| 2007/0237346 | A1 | 10/2007 | Fichtl et al. | |
| 2007/0269065 | A1 | 11/2007 | Kilsgaard | |
| 2007/0276285 | A1 | 11/2007 | Burrows et al. | |
| 2008/0019547 | A1 | 1/2008 | Baechler | |
| 2008/0037798 | A1 | 2/2008 | Baechler et al. | |
| 2008/0049957 | A1 | 2/2008 | Topholm | |
| 2008/0107296 | A1 | 5/2008 | Bachler et al. | |
| 2008/0260190 | A1 | 10/2008 | Kidmose | |
| 2010/0172524 | A1 | 7/2010 | Durant | |
| 2012/0155664 | A1 | 6/2012 | Zhang et al. | |

FOREIGN PATENT DOCUMENTS

| | | | |
|---|---|---|---|
| EP | 0396831 | A2 | 11/1990 |
| EP | 0191075 | B1 | 5/1992 |
| EP | 0537026 | A2 | 4/1993 |
| EP | 0335542 | B1 | 12/1994 |
| EP | 1414271 | A2 | 4/2004 |
| EP | 1256258 | B1 | 3/2005 |
| JP | 2001-175637 | | 6/2001 |
| WO | WO-9802825 | A2 | 1/1998 |
| WO | WO-0021332 | A2 | 4/2000 |
| WO | WO-0101564 | A1 | 1/2001 |
| WO | WO-0197564 | A2 | 12/2001 |
| WO | WO-03045108 | A2 | 5/2003 |
| WO | WO-03045108 | A3 | 5/2003 |
| WO | WO-2005002433 | A1 | 1/2005 |
| WO | WO-2005018275 | A2 | 2/2005 |
| WO | WO-2007020299 | A2 | 2/2007 |
| WO | WO-2007045276 | A1 | 4/2007 |
| WO | WO-2007112737 | A1 | 10/2007 |

OTHER PUBLICATIONS

"U.S. Appl. No. 10/051,757, Preliminary Amendment filed Mar. 22, 2002", 2 pgs.

"U.S. Appl. No. 10/051,757, Response filed Sep. 11, 2009 to Final Office Action mailed Jun. 11, 2009", 10 pgs.

"U.S. Appl. No. 11/276,795, Advisory Action mailed Jan. 12, 2010", 13 pgs.

"U.S. Appl. No. 11/276,795, Final Office Action mailed Oct. 14, 2009", 15 pgs.

"U.S. Appl. No. 11/276,795, Non-Final Office Action mailed May 27, 2010", 13 pgs.

"U.S. Appl. No. 11/276,795, Pre-Appeal Brief Request mailed Feb. 16, 2010", 4 pgs.

"U.S. Appl. No. 11/276,795, Response filed Sep. 8, 2009 to Non-Final Office Action mailed May 7, 2009", 10 pgs.

"U.S. Appl. No. 11/276,795, Response filed Dec. 14, 2009 to Final Office Action mailed Oct. 14, 2009", 10 pgs.

"European Application Serial No. 08253924.8, Office Action Mailed Feb. 12, 2010", 1 page.

"U.S. Appl. No. 11/276,795, Examiner Interview Summary filed Mar. 11, 2011", 1 pg.

"U.S. Appl. No. 11/276,795, Examiner Interview Summary mailed Feb. 9, 2011", 3 pgs.

"U.S. Appl. No. 11/276,795, Notice of Allowance mailed Mar. 18, 2011", 12 pgs.

"U.S. Appl. No. 11/276,795, Response filed Jan. 24, 2011 to Final Office Action mailed Nov. 24, 2010", 11 pgs.

"Canadian Application Serial No. 2,467,352, Office Action mailed Jul. 31, 2007", 3 pgs.

"European Application Serial No. 02803615.0, European Search Report mailed Aug. 17, 2007", 4 pgs.

"European Application Serial No. 02803615.0, Office Action mailed Aug. 22, 2007", 3 pgs.

"European Application Serial No. 02803615.0, Response filed Mar. 3, 2008 to Office Action mailed Aug. 22, 2007", 14 pgs.

"European Application Serial No. 02803615.0, Response filed Dec. 17, 2010 to Office Action mailed Aug. 9, 2010", 12 pgs.

"European Application Serial No. 07250920.1, Extended European Search Report mailed May 11, 2007", 6 pgs.

"U.S. Appl. No. 10/051,757, Final Office Action mailed Jun. 11, 2009", 24 pgs.

"U.S. Appl. No. 10/051,757, Non-Final Office Action mailed on Nov. 14, 2008", 30 pgs.

(56) References Cited

OTHER PUBLICATIONS

"U.S. Appl. No. 10/051,757, Response filed Feb. 17, 2009 to Non-Final Office Action mailed Nov. 14, 2008", 16 pgs.
"U.S. Appl. No. 11/276,795, Non Final Office Action mailed May 7, 2009", 13 pgs.
"European Application Serial No. 08253924.8, Search Report mailed on Jul. 1, 2009", 8 pgs.
Mueller, Gustav H, "Data logging: It's popular, but how can this feature be used to help patients?", *The Hearing Journal* vol. 60, No. 10,, XP002528491, (Oct. 2007), 6 pgs.
"U.S. Appl. No. 12/651,154, Preliminary Amendment mailed Dec. 31, 2009", 3 pgs.
"European Application Serial No. 08253924.8, Office Action Response Filed Aug. 13, 2010", 14 pgs.
"European Application Serial No. 02803615.0, Office Action mailed Apr. 5, 2007", 7 pgs.
"European Application Serial No. 07250920, Extended European Search Report mailed May 11, 2007", 6 pgs.
"U.S. Appl. No. 10/051,757, Non-Final Office Action mailed Jan. 13, 2006", 5 pgs.
"U.S. Appl. No. 10/051,757, Non-Final Office Action mailed Apr. 21, 2008", 19 pgs.
"U.S. Appl. No. 10/051,757, Non-Final Office Action mailed Sep. 21, 2007", 7 pgs.
"U.S. Appl. No. 10/051,757, Notice of Allowance mailed Mar. 16, 2007", 4 pgs.
"U.S. Appl. No. 10/051,757, Reponse filed Oct. 27, 2005 to Restriction Requirement filed Sep. 30, 2005", 11 pgs.
"U.S. Appl. No. 10/051,757, Response Filed Jan. 24, 2007 to Final Office Action mailed Aug. 24, 2006", 11 pgs.
"U.S. Appl. No. 10/051,757, Response Filed Jun. 9, 2006 to Non-Final Office Action mailed Jan. 13, 2006", 13 pgs.
"U.S. Appl. No. 10/051,757, Response filed Jul. 21, 2008 to Non-Final Office Action mailed Apr. 21, 2008", 14 pgs.
"U.S. Appl. No. 10/051,757, Restriction Requirement filed Sep. 30, 2005", 4 pgs.
"U.S. Appl. No. 10/051,757, Final Office Action mailed Aug. 24, 2006", 5 pgs.
"U.S. Appl. No. 10/051,757, Response filed Jan. 22, 2008 to Non-Final Office Action mailed Sep. 21, 2007", 15 pgs.
Byrne, D, "Paired Comparison Procedures in Hearing Aid Evaluations", *Ear & Hearing*, (1994), pp. 476-479.
Durant, E A., et al., "Hearing Aid Fitting with Genetic Algorithms", *Dissertation Presented at the International Hearing Aid Research Conference* (*IHCON*), (2002), 1 pg.
Griffing, Terry S, et al., "Acoustical Efficiency of Canal ITE Aids", *Audecibel*, (Spring 1983), 30-31.
Griffing, Terry S, et al., "Custom canal and mini in-the-ear hearing aids", *Hearing Instruments*, vol. 34, No. 2, (Feb. 1983), 31-32.
Griffing, Terry S, et al., "How to evaluate, sell, fit and modify canal aids", *Hearing Instruments*, vol. 35, No. 2, (Feb. 1984), 3.
Mahon, William J, "Hearing Aids Get a Presidential Endorsement", *The Hearing Journal*,, (Oct. 1983), 7-8.
Oshaki, M, et al., "Improvement of Presenting Interface by Predicting the Evaluation Order to Reduce the Burden of Human Interactive EC Operators", *SMC Conference Proceedings. IEEE International Conference on Systems, Man, and Cybernetics*, (1998), pp. 1284-1289.
Preves, David A., "Field Trial Evaluations of a Switched Directional/Omnidirectional In-the-Ear Hearing Instrument", *Journal of the American Academy of Audiology*, 10(5), (May 1999), 273-283.
Sullivan, Roy F, "Custom canal and concha hearing instruments: A real ear comparison Part I", *Hearing Instruments*, 40(4), (Jul. 1989), 5.
Sullivan, Roy F, "Custom canal and concha hearing instruments: A real ear comparison Part II", *Hearing Instruments*, vol. 40, No. 7, (Jul. 1989), 6.
Takagi, H, et al., "Discrete Fitness Values for Improving the Human Interface in an Interactive GA", *Proceedings of the IEEE International Conference on Evolutionary Computation*, (1996), pp. 109-112.
Takagi, H, et al., "IEC-based Hearing Aid Fitting", *IEEE International Conference on Systems, Man, and Cybernetics*, (1999), pp. 657-662.
Takagi, H, "System Optimization Without Numerical Target", *Biennial Conference of the North American Fuzzy Information Processing Society* (*NAFIPS*), (1996), pp. 351-354.
Watanabe, T, et al., "Recovering System of the Distorted Speech using Interactive Genetic Algorithms", *IEEE International Conference on Systems, Man, and Cybernetics. Intelligent Systems for the 21st Century*., (1995), pp. 684-689.
"U.S. Appl. No. 11/276,795, Decision on Pre-Appeal Brief Request mailed Apr. 14, 2010", 2 pgs.
"U.S. Appl. No. 11/276,795, Final Office Action mailed Nov. 24, 2010", 18 pgs.
"U.S. Appl. No. 11/276,795, Response filed Sep. 28, 2010 to Non Final Office Action mailed May 27, 2010", 6 pgs.
"U.S. Appl. No. 12/651,154, Supplemental Preliminary Amendment filed Jul. 1, 2010", 5 pgs.
"European Application Serial No. 02803615.0, Office Action mailed Aug. 9, 2010", 5 Pgs.
"European Application Serial No. 07250920.1, Office Action mailed Sep. 27, 2011", 5 pgs.
"U.S. Appl. No. 12/651,154, Final Office Action mailed Jul. 15, 2013", 10 pgs.
"U.S. Appl. No. 12/651,154, Non Final Office Action mailed Mar. 15, 2013", 13 pgs.
"U.S. Appl. No. 12/651,154, Non Final Office Action mailed Oct. 18, 2012", 10 pgs.
"U.S. Appl. No. 12/651,154, Notice of Allowance mailed Oct. 9, 2013", 10 pgs.
"U.S. Appl. No. 12/651,154, Response filed Jan. 18, 2013 to Non Final Office Action mailed Oct. 18, 2012", 8 pgs.
"U.S. Appl. No. 12/651,154, Response filed Jun. 17, 2013 to Non Final Office Action mailed Mar. 15, 2013", 10 pgs.
"U.S. Appl. No. 12/651,154, Response filed Aug. 30, 2012 to Non Final Office Action mailed Mar. 30, 2012", 7 pgs.
"U.S. Appl. No. 12/651,154, Response filed Sep. 16, 2013 to Final Office Action mailed Jul. 15, 2013", 9 pgs.
"U.S. Appl. No. 13/189,990, Advisory Action mailed Aug. 1, 2013", 3 pgs.
"U.S. Appl. No. 13/189,990, Final Office Action mailed May 22, 2013", 15 pgs.
"U.S. Appl. No. 13/189,990, Non Final Office Action mailed Nov. 26, 2012", 12 pgs.
"U.S. Appl. No. 13/189,990, Notice of Allowance mailed Sep. 18, 2013", 15 pgs.
"U.S. Appl. No. 13/189,990, Preliminary Amendment filed Mar. 5, 2012", 37 pgs.
"U.S. Appl. No. 13/189,990, Response filed Feb. 27, 2013 to Non Final Office Action mailed Nov. 26, 2012", 8 pgs.
"U.S. Appl. No. 13/189,990, Response filed Jul. 22, 2013 to Final Office Action mailed May 22, 2013", 8 pgs.
"European Application Serial No. 08253924.8, Office Action mailed Jul. 22, 2013", 6 pgs.

* cited by examiner

SYSTEM FOR CUSTOMIZING HEARING ASSISTANCE DEVICES

CROSS REFERENCE TO RELATED APPLICATION

This application is related to the following commonly assigned U.S. patent application which is herein incorporated by reference in its entirety: "Hearing Aids and Methods and Apparatus for Audio Fitting Thereof," Ser. No. 10/051,757, filed Jan. 16, 2002.

TECHNICAL FIELD

This disclosure relates generally to hearing assistance devices, and more particularly to a system for customizing hearing assistance devices.

BACKGROUND

Hearing instruments are electronic devices that provide signal processing functions such as noise reduction, amplification, and tone control. In many hearing assistance devices these and other functions can be programmably varied to fit the requirements of individual users.

Hearing assistance devices, such as hearing aids, include devices for use in the ear, in the ear canal, completely in the canal, and behind the ear. Such devices have been developed to ameliorate the effects of hearing losses in individuals. Hearing deficiencies can range from deafness to hearing losses where the individual has impairment responding to different frequencies of sound or to being able to differentiate sounds occurring simultaneously. The hearing assistance device in its most elementary form usually provides for auditory correction through the amplification and filtering of sound provided in the environment with the intent that the individual hears better than without the amplification.

Current hearing assistance devices provide a wide range of processing types and settings that may require extended interaction with the wearer and their environment to fine-tune (or customize) the device for the wearer. For example, the setting of single-microphone noise reduction parameters comprises a tradeoff between the amount of noise reduction and the amount of speech distortion. Different users of this technology use individual preferences for these variables, and preferences may vary under various acoustic surroundings. To customize a device, the dispenser of the hearing assistance device will either spend a significant amount of time assisting the wearer with fine-tuning, or the wearer is given a portable device to fine-tune the hearing assistance device on their own. The first method is unsatisfactory in that the fine-tuning may not be appropriate for the actual environments the users are typically exposed to, and because the process may take more time than is practical. The second method is unsatisfactory because the portable device may be cumbersome and intrusive or difficult to use while the wearer is attempting to fine-tune the hearing assistance device. These methods are also unsatisfactory in that, if the data associated with the fine-tuning are to be used by the device manufacturer to improve technology and its delivery, the burden of communicating this data must be shouldered by the dispenser.

Improved systems for customizing hearing assistance devices are needed.

SUMMARY

Disclosed herein, among other things, is a system for customizing a hearing assistance device for a wearer. According to various embodiments, data corresponding to the wearer's acoustic environment is logged using the hearing assistance device. In various embodiments, the hearing assistance device is fitted by an adaptive fitting process controlled by the wearer, the adaptive fitting process having access to the data logged by the hearing assistance device to customize settings of the hearing assistance device for the wearer. In an embodiment, data related to fitting the hearing assistance device is sent via a network connection to a location accessible by the wearer's audiologist and/or device manufacturer. The sent data is used to create an interactive database, and the database is used for fitting hearing assistance devices for one or more wearers, in various embodiments.

Disclosed herein, among other things is a method for customizing a hearing assistance device worn by a wearer at a location remote from a device dispenser. According to various embodiments, the method includes logging data in the wearer's typical sound environment using the hearing assistance device worn by the wearer. In various embodiments, the method includes establishing communications between the hearing assistance device and a computer at the wearer's location, the computer including a network connection. The method further includes, in various embodiments, fitting the hearing assistance device by a process executing at least in part on the computer that uses at least the logged data to customize the hearing assistance device by the wearer.

Disclosed herein, among other things, is a system for customizing a hearing assistance device worn by a wearer at a location remote from a device dispenser. According to various embodiments, the system includes means for logging data corresponding to the wearer's acoustic environment. The system further includes means for using an adaptive fitting procedure that uses the logged data to customize the hearing assistance device for the wearer. In an embodiment, the system includes means for providing a network connection to transmit data and means for storing transmitted data for use in customizing hearing assistance devices for one or more wearers.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present subject matter relates to a method for fine-tuning (or customizing, or fitting) a hearing assistance device in which a wearer is exposed to controlled conditions simulating their particular acoustic environments but not intruding on their going about their intended activities in these environments, and in which information concerning the customization and environments is made available transparently to the device manufacturer and dispenser.

Figure 1:
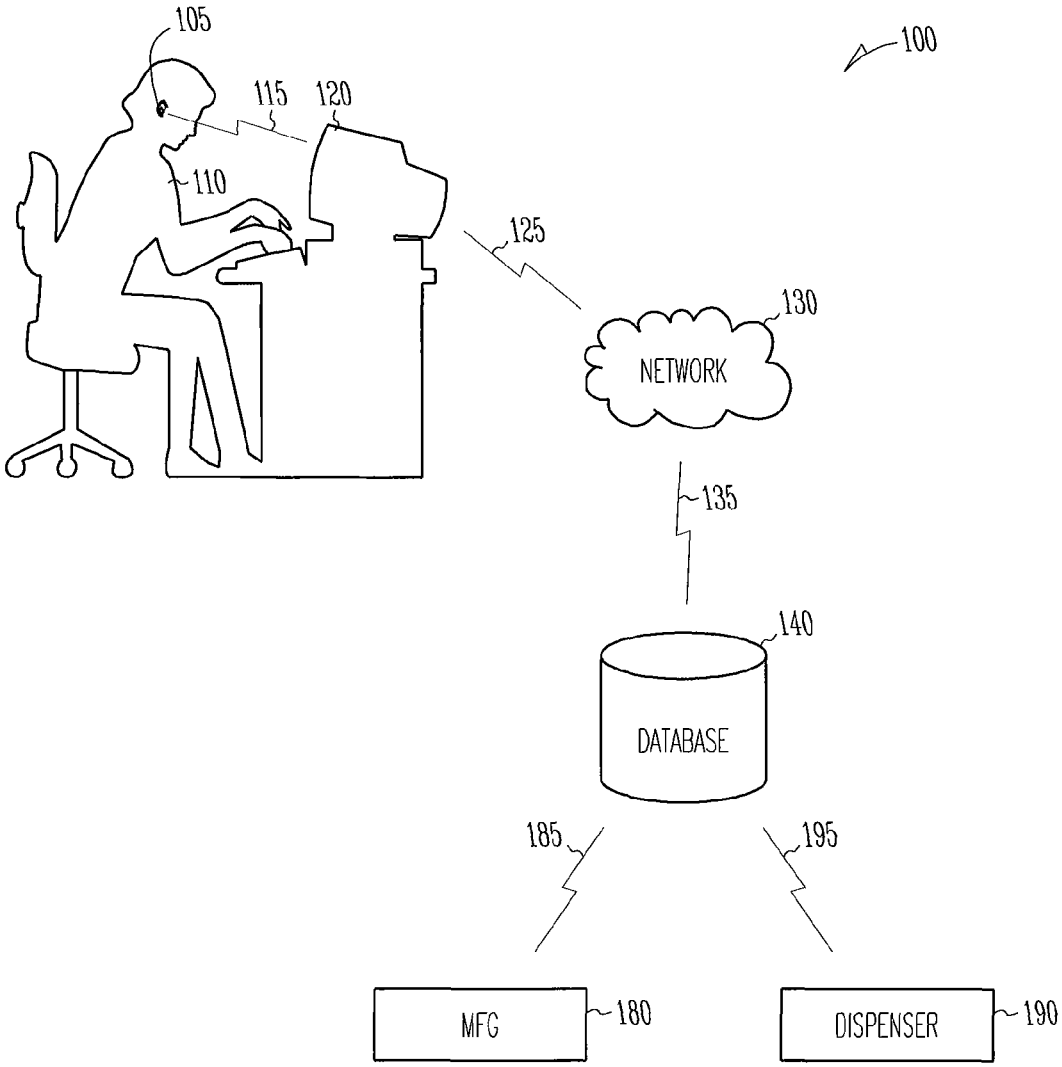
FIG. 1 illustrates a system for customizing a hearing assistance device worn by a wearer at a location remote from a device dispenser, according to one embodiment.

FIG. 1 illustrates a system 100 for customizing a hearing assistance device 105 worn by a wearer 110 at a location remote from a device dispenser 190, according to one embodiment. A device dispenser 190 refers to the audiologist or other entity or individual that provides the device to the wearer. The present subject matter relates to a system linking a wearer's hearing assistance device 105, a computer 120, and a database 140. The system is used to fine-tune (or customize, or fit) the hearing assistance device 105 to the wearer's preferences. In an embodiment, the wearer uses a personal computer 120, such as a personal computer in the form of a desk top computer, a laptop computer, a notebook computer, a hand-held computer device having a display screen, or any other computing device under the control of a program. In an embodiment, the computer has a connection 125 to a network 130, such as an Internet connection or broadband network for health care. A device connection 115 between the hearing assistance device 105 and the personal computer 120 can be wired, wireless or a combination of wired and wireless in various embodiments. Device connection 115 is also used to program hearing assistance device 105 with parameters for fitting hearing assistance device 105 in response to user interaction with the screen displays to determine the optimum values for these parameters. In one embodiment, connection 115 is a wireless communication medium that includes, but is not limited to, inductance, infrared, and RF transmissions. In other embodiments, connection 115 is a transmission medium that interfaces to computer 120 and hearing assistance device 105 using a standard type of interface such as PCMCIA, USB, RS-232, SCSI, or IEEE 1394 (Firewire). In various embodiments using these interfaces, hearing assistance device 105 includes a hearing aid and a peripheral unit removably coupled to the hearing aid for receiving the parameters from computer 120 to provide programming signals to the hearing aid. In another embodiment, a hearing aid is configured to receive signals directly from computer 120. A computer connection 125 between the personal computer 120 and the network 130 can be wired or wireless in various embodiments.

In an embodiment, the wearer 110 initiates a customization session on the personal computer 120, and software on the computer reads data logged in the hearing assistance device and/or queries the wearer. Logged data includes data indicative of the wearer's particular acoustic environment, and can be logged using dedicated logging hardware or the hearing assistance device 105 itself. The availability of logged data provides a starting point for fitting and can reduce or focus the questions that the software asks the wearer. Logging data for use in hearing assistance device (including behind the ear, in the ear, completely in the ear, or implanted devices) programming refers to recording information in a hearing device and/or in a recording unit at least temporarily operationally connected to the hearing device. A point in time of the recording or a recording frequency as well as the information to be recorded, as data, parameters or adjustments of the hearing device are adjusted or programmable. Logged data includes the current acoustic surrounding together with other relevant information, such as time of recording. The parameters that are adjustable in a hearing device can be checked all together or selectively in real acoustic environments in order to optimally adjust the hearing assistance device. Because of the number of the parameters being adjustable, selective recording is used because there is limited memory space and available battery capacity in the hearing assistance device.

In various embodiments, the wearer can direct the system to record data representative of an issue experienced by the wearer. For instance, if the wearer detects a problem with listening in a certain environment, the wearer can take an action which will record certain information relating to that environment for later use in determining the cause or a solution. For example, when instructed by the wearer the device may record certain sound parameters. The device may also record actual sound. The device may record settings of the hearing assistance device. Other data may be recorded that may be useful for later analysis of the sound environment. The data can be stored on the device and later downloaded to a computer. It can also be sent to the computer as needed. The data can be used for better fitting of the device in certain special or problematic listening situations. In various embodiments, the wearer can signal an instruction to record upon depressing a pushbutton, use of a remote control, or some such other way to signal the device to record information specially. Such recordings can assist in making fine tunings to the hearing assistance device. In another embodiment, the hearing assistance device identifies noisy environments using environment classification processes and automatically logs data when the received signal fits some specified criteria. In various embodiments, the device can enter or exit special recording modes based on events or by using a recording timer to control the duration of special recordings.

The logged data and query responses are used to generate audio stimuli that will mimic the environments the wearer has experienced and under which the wearer has indicated they want optimization to occur. The software system leads the wearer through one or more presentations of audio stimuli, configuring the hearing assistance device in different ways and obtaining preference responses from the wearer in order to determine the optimal setting of the device 105 for the particular environment under test. In an embodiment, this is accomplished under the control of an optimization routine. In one embodiment the optimization routine includes a genetic algorithm. Other optimization routines are possible without departing from the scope of the present subject matter. The use of adaptive algorithms for fitting hearing assistance devices is discussed in the related reference which has been incorporated by reference herein. The wearer 110 can customize the device 105 under one or more environments, in various embodiments. Once customization of desired environments is completed, information such as data logging, configurations and response data is related to a network database 140 (such as an internet database) for use by the dispenser/audiologist 190 and/or device manufacturer 180. The connections between the network 130 and database 150 (connection 135), the database 140 and manufacturer 180 (connection 185), and the database 140 and dispenser 190 (connection 195), can be wired or wireless in various embodiments.

In various embodiments, the device to be fitted can be a single ear device or a binaural device. Various parameters can be adjusted during fitting and fine-tuning, including, but are not limited to: channel gain, band gain, threshold knee points, and volume control.

Figure 2:
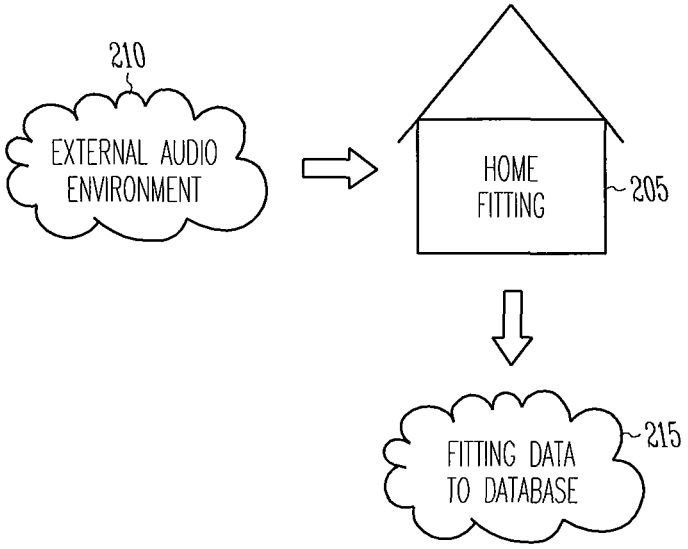
FIG. 2 illustrates a flow diagram for fitting a hearing assistance device at a location chosen by a wearer, according to one embodiment.

FIG. 2 illustrates a flow diagram for fitting a hearing assistance device at a location chosen by a wearer, according to one embodiment. A system is provided for combining data-logging, the internet, and interactive software in a manner that will allow the wearer of a hearing assistance device to fine-tune (or customize, or fit) their device in the privacy of their own home, at 205 (or at a location of their choosing, such as the dispenser's office). In this system, the wearer's device is connected to a computer which is in turn connected to a network. The wearer activates software in the computer that communicates with the hearing assistance device and a remote database, the database accessible to the wearer, the dispenser or audiologist, and the device manufacturer. The software can be loaded on the computer directly with a compact disk or diskette, or can be downloaded from a network connection, or can run as a web-based module. The software uses logged data, stored in the device or a separate logging module, the logged data including statistics descriptive of the acoustic environments frequented by the wearer and the wearer's reaction thereto (e.g. a "yes/no" response to a query such as "my hearing assistance device is performing well in the current environment?") to configure audio stimuli and possible hearing assistance device settings. The software runs the wearer through a series of tests using the stimuli and settings in order to determine optimal configurations of the hearing assistance device for different environments, at 210. In an embodiment, this is accomplished under the control of an optimization routine or adaptive fitting algorithm. One example includes, but is not limited to, a genetic algorithm. In various embodiments, the system saves the data-logging and fine-tuning information in a network database, at 215, making it available for the manufacturer and dispenser to improve the technology and delivery systems.

Also provided herein is a system for customizing a hearing assistance device worn by a wearer at a location remote from a device dispenser. According to various embodiments, the system includes means for logging data corresponding to the wearer's acoustic environment. The system further includes means for using an adaptive fitting procedure that uses the logged data to customize the hearing assistance device for the wearer. The customizing means can include a personal computer, such as a laptop or desktop. In an embodiment, the system includes means for providing an Internet connection to transmit data and means for storing transmitted data for use in customizing hearing assistance devices for one or more wearers.

According to various embodiments, the system further includes means for providing an Internet connection to transmit data. Transmitted data can include logged data and/or parameters derived from customizing the device. Data to provide this information is input to the computer through user input from the keyboard, from a computer readable medium such as a diskette or a compact disc, from a database not contained within the computer via wired or wireless connections, and/or from the hearing assistance device. The system also includes means for storing transmitted data for use in customizing hearing assistance devices for one or more wearers, in an embodiment. The means for storing can include an interactive database accessible by at least one of the device dispenser and a device manufacturer. The means for logging date can include the hearing assistance device itself, or a separate device for logging data.

Figure 3:
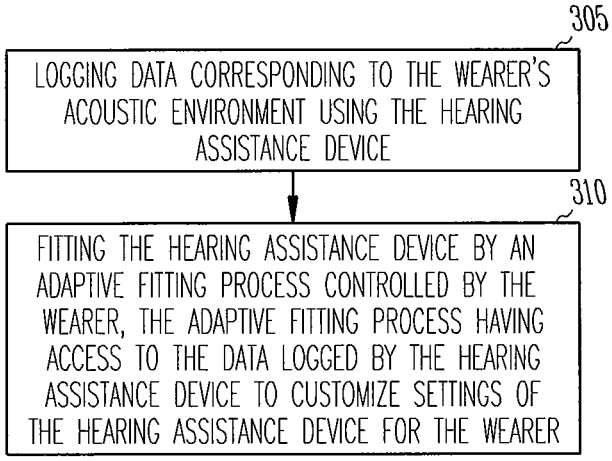
FIG. 3 illustrates a flow diagram of a method for customizing a hearing assistance device for a wearer, according to one embodiment.

FIG. 3 illustrates a flow diagram of a method for customizing a hearing assistance device for a wearer, according to one embodiment. According to various embodiments, data corresponding to the wearer's acoustic environment is logged using the hearing assistance device, at 305. In various embodiments, the hearing assistance device is fitted by an adaptive fitting process controlled by the wearer, the adaptive fitting process having access to the data logged by the hearing assistance device to customize settings of the hearing assistance device for the wearer, at 310.

In an embodiment, data related to fitting the hearing assistance device is sent via a network connection to a location accessible by the wearer's audiologist and/or device manufacturer. Sent data includes parameters derived from fitting the hearing assistance device and/or logged data, in various embodiments. The sent data is used to create an interactive database, and the database is used for fitting hearing assistance devices for one or more wearers, in various embodiments. In one embodiment, using an adaptive fitting procedure includes using a genetic algorithm. Other embodiments employing different optimization approaches are possible without departing from the scope of the present subject matter.

Logging data can include recording environmental data using the hearing assistance device. In various embodiments, logging data includes recording environmental data under the direction of the wearer. Allowing the wearer to control recording provides data to the customizing procedure regarding circumstances where the wearer's device needs modification. In an example, the wearer's device performs well most of the time but when the wearer enters a particular environment (such as a restaurant, for example) the device performance declines. In this instance, the wearer can hold a button down on the device or use a remote control, and the device may record information concerning a particular environment. In another embodiment, the hearing assistance device identifies noisy environments itself using environment classification and automatically logs data when the received signal fits some specified criteria. The wearer may also record instances when the device does not operate satisfactorily. In such environments, the device may mark recorded data to indicate an incident that the wearer's audiologist or other professional may review to attempt to determine whether the device operated properly, or whether it could be better fitted, for example. In one embodiment, recorded data is stored. Such data may include settings of the device and may include recorded sound, or combinations of both. In one embodiment statistics concerning the acoustic environment are stored. In one embodiment, new information not regularly acquired is stored. For example, the information may include parameters and statistics that are not regularly stored to better diagnose the operation of the device. In various embodiments, combinations of the data set forth herein are stored. It is understood that a variety of information may be stored without departing from the scope of the present subject matter.

Figure 4:
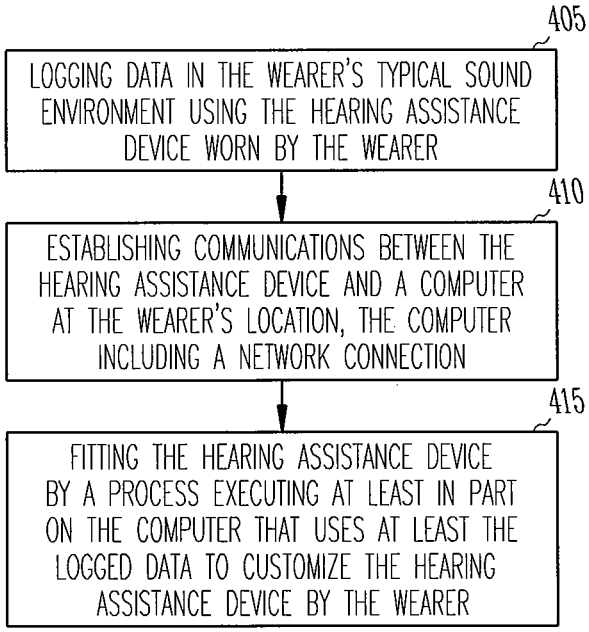
FIG. 4 illustrates a flow diagram of a method for customizing a hearing assistance device worn by a wearer at a location remote from a device dispenser, according to one embodiment.

FIG. 4 illustrates a flow diagram of a method for customizing a hearing assistance device worn by a wearer at a location remote from a device dispenser, according to one embodiment. According to various embodiments, the method includes logging data in the wearer's typical sound environment using the hearing assistance device worn by the wearer, at 405. In various embodiments, the method includes establishing communications between the hearing assistance device and a computer at the wearer's location, the computer including a network connection, at 410. The method further includes, in various embodiments, fitting the hearing assistance device by a process executing at least in part on the computer that uses at least the logged data to customize the hearing assistance device by the wearer, at 415.

According to various embodiments, logging data includes recording data relating to statistics descriptive of acoustic environments frequented by the wearer. Logging data can also include recording data relating to the wearer's reaction to acoustic environments frequented by the wearer. Recording data relating to the wearer's reaction to acoustic environments includes recording answers to questions posed to the wearer by the computer, in an embodiment. In another embodiment, recording data relating to the wearer's reaction to acoustic environments includes recording the wearer's responses to prerecorded stimuli. In various embodiments, the method includes connecting the device to a computer having a connection to a broadband network for healthcare. Another example of a network connection includes an Internet connection. The computer can be further programmed to save logged data and/or data indicative of the customized hearing assistance device settings in a database accessible via the network connection. In one embodiment, a genetic algorithm is performed to aid in fitting the hearing assistance device. Other fitting approaches may be used without departing from the scope of the present subject matter.

The present subject matter provides a convenient customization of a wearer's hearing assistance device in which a wearer is exposed to controlled conditions simulating their particular acoustic environments but not intruding on their going about their intended activities in these environments. A dispenser need not attempt to blindly replicate a wearer's normal environment at the dispenser's location. Since information concerning the customization and environments is made available transparently to the device dispenser, the dispenser can categorize individuals that have different sounds in their environment for future customizations. Data can be logged continuously throughout the course of the wearer's daily activities, contributing to a more robust customization. In various embodiments, adaptive fitting algorithms, such as genetic algorithms, provide for proper fitting. Genetic algorithms benefit from access to data from fittings of a population and can further fine-tune device parameters based on past fittings. Other fitting algorithms may be employed without departing from the scope of the present subject matter.

In the fitting process, it is understood that the wearer of the hearing aid may receive sounds for fitting from a variety of possible sources. In various embodiments the sounds are produced via a connection to a direct audio input to have the hearing assistance device generate the sounds. In various embodiments the connection includes, but is not limited to: a wireless connection to electronics providing signals to the direct audio input, a wired connection to the direct audio input, or combinations thereof. Thus, in this approach, the speaker/receiver in the hearing assistance device is the only physical source of sound for the fitting process. In various embodiments, the computer drives some speakers, generating sound which is received by one or more microphones of the hearing assistance device. Other connections are possible, including, but not limited to, wireless communications to a wireless interface connected to, or integral to, the hearing assistance device. Such embodiments include, but are not limited to, packetized communications and may involve streaming audio signals. Other connections are possible without departing from the scope of the present subject matter.

The present subject matter includes hearing assistance devices, including, but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in-the-canal. It is understood that other hearing assistance devices not expressly stated herein may fall within the scope of the present subject matter It is understood one of skill in the art, upon reading and understanding the present application will appreciate that variations of order, information or connections are possible without departing from the present teachings.

Additionally, one of ordinary skill in the art will understand that, the systems shown and described herein can be implemented using software, hardware, and combinations of software and hardware. As such, the term "system" is intended to encompass software implementations, hardware implementations, and software and hardware implementations.

This application is intended to cover adaptations or variations of the present subject matter. It is to be understood that the above description is intended to be illustrative, and not restrictive. The scope of the present subject matter should be determined with reference to the appended claims, along with the full scope of equivalents to which such claims are entitled.

We claim:

1. A method for customizing a hearing assistance device for a wearer, comprising:

logging data corresponding to the wearer's acoustic environment using the hearing assistance device, the logging initiated upon a recording instruction by the wearer entered during operation of the device; and fitting the hearing assistance device by a fitting process controlled by the wearer, the fitting process having access to the data logged by the hearing assistance device to customize settings of the hearing assistance device for the wearer, wherein logging data includes recording data relating to statistics descriptive of acoustic environments frequented by the wearer.

2. The method of claim 1, further comprising:

sending information relating to the fitting to a remote location using an Internet connection.

3. The method of claim 2, wherein sending includes sending one or more parameters related to the settings of the hearing assistance device derived from the fitting.

4. The method of claim 2, wherein sending includes sending to a location accessible by the wearer's audiologist.

5. The method of claim 4, further comprising:

creating an interactive database from the sent data.

6. The method of claim 5, further comprising:

using the database for one or more adaptive fitting processes for fitting hearing assistance devices for one or more wearers.

7. The method of claim 1, wherein fitting the hearing assistance device includes using an adaptive fitting process.

8. The method of claim 7, wherein the adaptive fitting process includes using a genetic algorithm.

9. The method of claim 1, wherein logging data includes recording environmental data using the hearing assistance device.

10. The method of claim 1, wherein logging data includes recording data associated with the use of the device under the direction of the wearer.

11. A method for customizing a hearing assistance device worn by a wearer at a location remote from a device dispenser, comprising:

logging data in the wearer's typical sound environment using the hearing assistance device worn by the wearer, the logging initiated upon a recording instruction by the wearer entered during operation of the device;

establishing communications between the hearing assistance device and a computer at the wearer's location, the computer configured for a network connection;

fitting the hearing assistance device by a process using the computer that uses the logged data to customize the hearing assistance device by the wearer; and recording data associated with the use of the device under the direction of the wearer.

12. The method of claim 11, wherein logging data includes recording data relating to statistics descriptive of acoustic environments frequented by the wearer.

13. The method of claim 11, comprising recording data relating to the wearer's reaction to acoustic environments frequented by the wearer.

14. The method of claim 13, wherein recording data relating to the wearer's reaction to acoustic environments includes recording answers to questions posed to the wearer by the computer.

15. The method of claim 14, comprising generating audio stimuli that mimic an environment the wearer has experienced where the wearer has indicated optimization to occur.

16. The method of claim 11, comprising using an adaptive fitting process to fit the device to a wearer.

17. The method of claim 16, wherein the adaptive fitting process includes using a genetic algorithm.

18. The method of claim 11, comprising connecting the computer to a broadband network for healthcare.

19. The method of claim 11, comprising connecting the computer to an Internet connection.

20. The method of claim 19, comprising saving logged data in a database accessible via the Internet connection.

21. The method of claim 19, comprising saving data indicative of the customized hearing assistance device settings in a database accessible via the Internet connection.

22. The method of claim 11, wherein fitting the hearing assistance device includes connecting the computer to a direct audio input connection of the wearer's hearing assistance device to play sounds.

23. The method of claim 11, wherein fitting the hearing assistance device includes wirelessly communicating with the computer to play sounds for fitting the hearing assistance device to the wearer.

24. The method of claim 11, wherein fitting the hearing assistance device includes playing sounds using speakers that are received by the hearing assistance device for fitting the hearing assistance device to the wearer.

25. A method for customizing a hearing assistance device worn by a wearer at a location remote from a device dispenser, comprising:

logging data in the wearer's typical sound environment using the hearing assistance device worn by the wearer, the logging initiated upon a recording instruction by the wearer entered during operation of the device;

establishing communications between the hearing assistance device and a computer at the wearer's location, the computer configured for a network connection; and fitting the hearing assistance device by a process using the computer that uses the logged data to customize the hearing assistance device by the wearer, wherein logging data includes recording data relating to statistics descriptive of acoustic environments frequented by the wearer.

26. A method for customizing a hearing assistance device worn by a wearer at a location remote from a device dispenser, comprising:

logging data in the wearer's typical sound environment using the hearing assistance device worn by the wearer, the logging initiated upon a recording instruction by the wearer entered during operation of the device;

establishing communications between the hearing assistance device and a computer at the wearer's location, the computer configured for a network connection;

fitting the hearing assistance device by a process using the computer that uses the logged data to customize the hearing assistance device by the wearer; and recording data relating to the wearer's reaction to acoustic environments frequented by the wearer.

27. The method of claim 26, wherein recording data relating to the wearer's reaction to acoustic environments includes recording answers to questions posed to the wearer by the computer.

28. The method of claim 27, comprising generating audio stimuli that mimic an environment the wearer has experienced where the wearer has indicated optimization to occur.

29. A method for customizing a hearing assistance device worn by a wearer at a location remote from a device dispenser, comprising:

logging data in the wearer's typical sound environment using the hearing assistance device worn by the wearer, the logging initiated upon a recording instruction by the wearer entered during operation of the device;

establishing communications between the hearing assistance device and a computer at the wearer's location, the computer configured for a network connection; and fitting the hearing assistance device by a process using the computer that uses the logged data to customize the hearing assistance device by the wearer, wherein fitting the hearing assistance device includes connecting the computer to a direct audio input connection of the wearer's hearing assistance device to play sounds.

30. A method for customizing a hearing assistance device worn by a wearer at a location remote from a device dispenser, comprising:

logging data in the wearer's typical sound environment using the hearing assistance device worn by the wearer, the logging initiated upon a recording instruction by the wearer entered during operation of the device;

establishing communications between the hearing assistance device and a computer at the wearer's location, the computer configured for a network connection; and fitting the hearing assistance device by a process using the computer that uses the logged data to customize the hearing assistance device by the wearer, wherein fitting the hearing assistance device includes wirelessly communicating with the computer to play sounds for fitting the hearing assistance device to the wearer.

31. A method for customizing a hearing assistance device worn by a wearer at a location remote from a device dispenser, comprising:

logging data in the wearer's typical sound environment using the hearing assistance device worn by the wearer, the logging initiated upon a recording instruction by the wearer entered during operation of the device;

establishing communications between the hearing assistance device and a computer at the wearer's location, the computer configured for a network connection; and fitting the hearing assistance device by a process using the computer that uses the logged data to customize the hearing assistance device by the wearer, wherein fitting the hearing assistance device includes playing sounds using speakers that are received by the hearing assistance device for fitting the hearing assistance device to the wearer.

* * * * *

UNITED STATES PATENT AND TRADEMARK OFFICE

CERTIFICATE OF CORRECTION

PATENT NO. : 8,718,288 B2
APPLICATION NO. : 11/957161
DATED : May 6, 2014
INVENTOR(S) : Woods et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1605 days.

Signed and Sealed this
Eleventh Day of August, 2015

Michelle K. Lee

Michelle K. Lee
*Director of the United States Patent and Trademark Office*